US005806697A

United States Patent [19]

Harbutt et al.

[11] Patent Number: 5,806,697

[45] Date of Patent: Sep. 15, 1998

[54] FITMENT REMOVAL PREVENTION DEVICE FOR CONTAINERS

[75] Inventors: Richard Paul Harbutt, Gomshall; Alexander Speirs Laurie, Royston; Peter Thomas Mence Nott, Limpley Stoke; David Christopher Snow, Stonehouse, all of United Kingdom

[73] Assignee: United Distillers PLC, Edinburgh, United Kingdom

[21] Appl. No.: 633,739

[22] PCT Filed: Oct. 24, 1994

[86] PCT No.: PCT/GB94/02336

§ 371 Date: Jun. 27, 1996

§ 102(e) Date: Jun. 27, 1996

[87] PCT Pub. No.: WO95/11173

PCT Pub. Date: Apr. 27, 1995

[30] Foreign Application Priority Data

Oct. 22, 1993 [GB] United Kingdom ..... 9321787

[51] Int. Cl.[6] ..... B65D 39/00

[52] U.S. Cl. ..... 215/17; 215/47; 215/294; 215/263

[58] Field of Search ..... 215/17, 18, 20, 215/26, 47, 48, 54, 50, 293, 294, 263, 358, 364, 311; 222/147, 153.09, 153.1, 563

[56] References Cited

U.S. PATENT DOCUMENTS

| | | | |
|---|---|---|---|
| 626,417 | 6/1899 | Freese | 215/18 |
| 683,883 | 10/1901 | Myers | 215/50 X |
| 734,323 | 7/1903 | Harrison | 215/54 |
| 815,112 | 3/1906 | O'Dell et al. | 215/18 |
| 1,308,697 | 7/1919 | Cadmus | 215/294 X |
| 2,032,478 | 3/1936 | Haase | 215/294 |
| 2,091,460 | 8/1937 | Valliant et al. | 215/18 |
| 2,101,598 | 12/1937 | Riedel | 215/47 X |

FOREIGN PATENT DOCUMENTS

| | | | |
|---|---|---|---|
| 2071044 | 9/1981 | United Kingdom | 215/17 |

*Primary Examiner*—Allan N. Shoap
*Assistant Examiner*—Nathan Newhouse
*Attorney, Agent, or Firm*—Antonelli, Terry, Stout & Kraus, LLP

[57] ABSTRACT

A fitment removal prevention device for insertion within a container having a rigid mouth portion. The device has a body portion and an incompressible member movable with respect to the body portion and biased from a first position, in which the device is insertable into the container, to a second position, in which the incompressible member engages the container and exerts a force on the mouth portion of the container in a first direction having a component transverse to the direction of extraction of the device from the container. Upon attempted extraction of the fitment removal prevention device from the container, the incompressible member exerts an increased force on the mouth portion of the container in the first direction, thereby retaining the device in the container.

25 Claims, 9 Drawing Sheets

202
214
210
212
206
200
208
10
204
22

FITMENT REMOVAL PREVENTION DEVICE FOR CONTAINERS

BACKGROUND OF THE INVENTION

The present invention relates to a fitment removal prevention device for insertion within a container, and to a fitment removal prevention device in combination with a container.

In order to discourage the refilling of branded containers with a counterfeit product, many manufacturers are now taking the step of installing a one-way liquid dispensing valve or other fitment within a neck of the container. It has been found, however, that the determined counterfeiter will simply remove the entire fitment from the container, refill the container with a counterfeit product and then replace the original fitment. There is, therefore, an increasing demand for means of preventing the removal of these fitments from the containers concerned.

SUMMARY OF THE INVENTION

According to a first aspect of the present invention, there is provided a fitment removal prevention device for insertion within a container having a rigid mouth portion, said device comprising a body portion and an incompressible member moveable with respect to the body portion and biased from a first position in which the device is insertable into the container to a second position in which the member engages the container and exerts a force on the mouth portion in a first direction having a component transverse to the direction of extraction of the device from the container so as to thereby retain the device with respect to the container, the device being adapted such that the member exerts an increased force on the mouth portion in said first direction upon attempted extraction of the device from the container.

Advantageously, the device may have a dimension perpendicular to the direction of extraction of the device from the container when the member is in said second position which is greater than the corresponding dimension when the member is in said first position.

Advantageously, the body portion may include a ramp surface inclined inwardly of the mouth portion in the direction of extraction of the device from the container, the member being in engagement with the ramp surface and biased in a direction having a component opposed to said direction of extraction.

Advantageously, the device may include resilient means for biasing the member from said first position, in which the member engages a first portion of the ramp surface, to said second position, in which the member engages a second portion of the ramp surface, the movement of the member between said first and second positions being in a direction having a component transverse to the direction of extraction of the device from the container.

Advantageously, the ramp surface and the member with which it is in engagement may be shaped such that a reaction force exerted by the mouth portion on the member may be absorbed other than through the centre of the body portion. Preferably, the ramp surface may have a shape in a cross-section taken perpendicular to the direction of extraction of the device from the container selected from the list comprising arcuate, triangular and square.

Advantageously, the ramp surface may be flared outwardly in a direction opposed to the direction of extraction of the device from the container.

Advantageously, the ramp surface may be disposed helically of the body portion.

Advantageously, the ramp surface may be provided around its periphery with a plurality of such ramp surfaces, each angularly spaced from the adjacent ramp surfaces and each in engagement with a respective incompressible member.

Advantageously, the or each incompressible member may be provided with a rolling surface for engagement with a respective ramp surface. Preferably, the member may have a shape selected from the list comprising spherical, part spherical, cylindrical and barrel-shaped.

Advantageously, the device may comprise means for retaining the or each of the Incompressible members with respect to the body portion.

Advantageously, resilient means may be provided integrally of the retaining means for biasing the or each of the members from said first position to said second position.

Advantageously, the member may comprise an over-centre locking member that frictionally engages the container when in said second position. To this end, the member may comprise a plurality of sprag elements angularly spaced about the periphery of the body portion. Alternatively, the member may be disposed peripherally of the body portion and adapted to flex from said first position to said second position.

Advantageously, the body portion may be provided with a through bore that in use communicates with an interior of the container. Alternatively, or in addition, the body portion may be provided around its periphery with a plurality of cut away portions which, with the mouth portion, serve to define a plurality of openings that in use communicate with an interior of the container.

Advantageously, the device may be formed integrally with a one-way liquid dispensing valve or other fitment.

According to a second aspect of the present invention, there is provided a fitment removal prevention device in combination with a container having a rigid mouth portion, the device comprising a body portion and an incompressible member moveable with respect to the body portion and biased from a first position in which the device is insertable into the container to a second position in which the member engages the container and exerts a force on the mouth portion in a first direction having a component transverse to the direction of extraction of the device from the container so as to thereby retain the device with respect to the container, the device being adapted such that the member exerts an increased force on the mouth portion in said first direction on attempted extraction of the device from the container.

Advantageously, the mouth portion may be frangible and the increased force exerted by the member on the mouth portion upon attempted extraction of the device from the container be sufficient to break the mouth portion.

Advantageously, the mouth portion may be provided with one or more formations for engagement by the member when the member is in said second position.

Advantageously, the mouth portion may in part be defined by an inner surface that tapers outwardly in the direction of extraction of the device from the container, the device having a ramp surface which is inclined inwardly of the mouth portion in said direction of extraction at an angle which is greater than that with which the inner surface is tapered outwardly.

Advantageously, the device may be provided with a respective ramp surface for engagement by the or each of the members, the device being adapted such that the coefficient of friction between the or each of the members and the mouth portion is such that substantially no slippage occurs between the or each of the members and the mouth portion upon the attempted extraction of the device from the container. In such an arrangement, the relative coefficients of friction between the or each of the members and the mouth portion and between the or each of the members and their respective ramp surfaces may be such as to allow the or each of the members to roll with respect to their respective ramp surfaces as the device is attempted to be removed from the container.

BRIEF DESCRIPTION OF THE DRAWINGS

A number of embodiments of the present invention will now be described by way of example with reference to the accompanying drawings in which.

DETAILED DESCRIPTION OF PREFERRED EMBODIMENT

Figure 1:
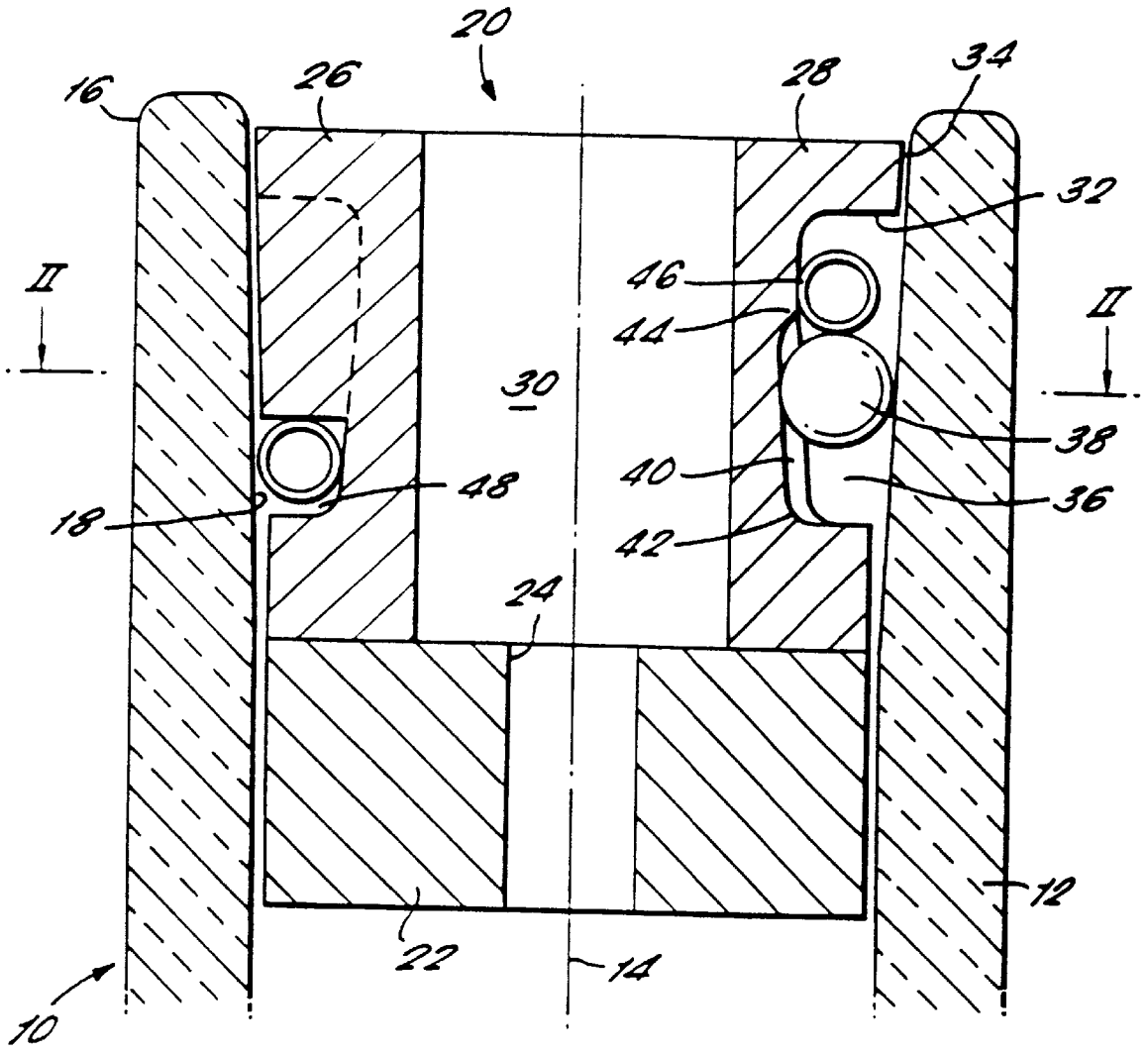
FIG. 1 is a cross-sectional view of a neck portion of a container in which there is disposed a fitment removal prevention device in accordance with a first embodiment of the present invention.

Referring to FIG. 1 there is shown a bottle 10 having a substantially cylindrical neck portion 12 symmetric about a central axis 14. The neck portion 12 is defined by a generally cylindrical outer surface 16 and an inner surface 18 that tapers outwardly at an angle of between one and two degrees to define a flared mouth portion 20. Both the bottle 10 and the neck portion 12 are formed of glass.

Within the neck portion 12 there is disposed a fitment 22 such as, for example, a one-way liquid dispensing valve. This fitment 22 may be of any convenient design and in the embodiment shown is provided with a passage 24 coaxial with the central axis 14 for dispensing the contents of the bottle 10. A removal prevention device 26 is interposed between the fitment 22 and the mouth 20 of the bottle to prevent the removal of the fitment from the bottle 10.

Figure 2:
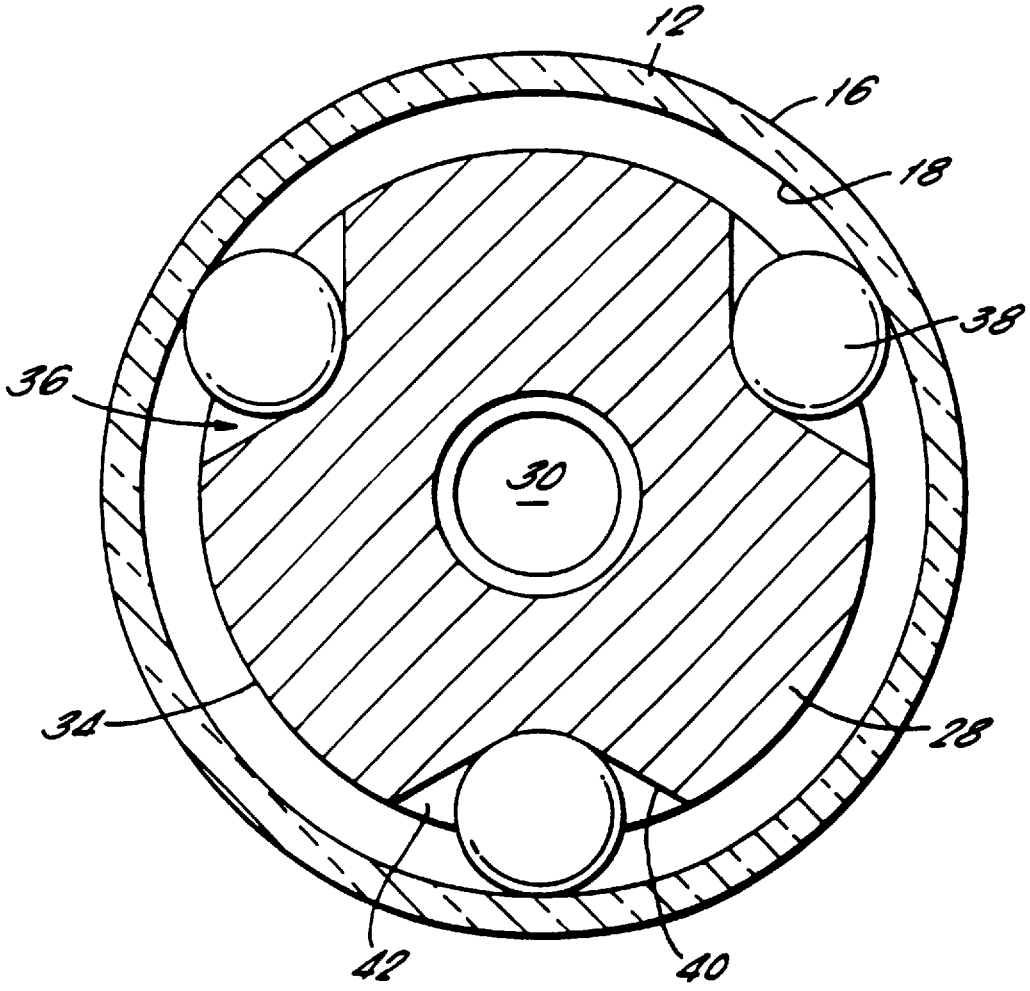
FIG. 2 is a cross-sectional view of the device of FIG. 1 taken along line II—II.

Turning to FIG. 2, the removal prevention device 26 can be seen to comprise a substantially cylindrical body portion 28 having a central through bore 30 coaxial with the central axis 14. Three cut-away regions 32, spaced apart by 120 degrees, are provided within an outer surface 34 of the body portion 28 and define, with the inner surface of the neck portion 18, three circumferentially spaced openings 36 for the receipt of a respective ball 38 of a ceramic or other incompressible material. Within each of these openings 36 there is provided on the body portion 28 a ramp surface 40 which is both arcuate in a cross-section taken perpendicular to the central axis 14, as seen from FIG. 2, and inclined to that axis at an angle of between approximately 4 and 10 degrees, as seen from FIG. 1. As a result, as also seen from FIG. 1, distance between the ramp surface 40 and the inner surface of the neck portion 18 decreases as one moves along the ramp surface toward the fitment 22.

At an end proximate the fitment 22, the ramp surface 40 terminates in an outwardly directed shoulder 42 that interconnects the ramp surface with the outer surface of the body portion 34. By contrast, the opposite and more distal end of the ramp surface 40 terminates in a second, but less well pronounced, outwardly directed shoulder 44 that interconnects the ramp surface with a part of the cut-away region 32 that cooperates with the inner surface of the neck portion 18 to house a spring 46. The spring 46 extends circumferentially of the body portion 28 and bears in turn against each of the balls 38 to urge the balls in the direction of the fitment 22 and into engagement with both the ramp surface 40 and the inner surface of the neck portion 18. To this end the spring 46 follows a path which is somewhat sinusoidal in nature with the spring held at intervals between the cut-away regions 32 much closer to the fitment 22 by engagement within a circumferential channel 48.

The body portion 28 may be of any convenient rigid material and is preferably formed of a suitable metal or of a thermoset resin such a phenolic resin or melamine formaldehyde.

In use the fitment 22 may be inserted within the neck portion 12 in any convenient manner. The removal prevention device 26 is then presented to the mouth of the bottle 10 with the spring 46 retained relative to the body portion 28 by engagement with the circumferential channel 48 and with the balls 38 held loosely in the circumferentially openings 36. As the device 26 is pushed home to the position shown in FIG. 1 there will be a tendency for each of the balls 38 to rise-up its respective ramp surface 40 toward the second shoulder 44. This is partially because the ramp surfaces 40 are inclined to the central axis 14 at a greater angle than the inner surface of the neck portion 18 and partially because the coefficient of friction between the ceramic balls 38 and the glass of the neck portion 12 is greater than that between the balls and the body portion 28. This tendency, however, is countered by the action of the spring 46 which acts to maintain the balls 38 in engagement with their respective ramp surfaces 40 until the device 26 has been inserted to such an extent that any movement of the balls 38 away from the ramp surfaces 40 is resisted by the narrowing of the distance between the ramp surface 40 and the inner surface of the neck portion 18.

With the fitment and the device in the position shown in FIG. 1, the contents of the bottle 10 may be dispensed in the usual way. Thus, if the bottle were to be inverted, its contents would flow through the passage 24 in the fitment 32, through the communicating through bore 30 in the body portion 28 and out of the mouth 20 of the bottle.

At the same time however, the device 26 serves to prevent the removal of the fitment 22 from the bottle 10, since to do so the potential counterfeiter must first remove the device itself. Should he nevertheless attempt to do this by simply pulling the body portion 28 from the neck portion 12, a state of slip will be established between the ramp surfaces 40 and the respective balls 38 with which they engage, with the result that the balls will remain substantially stationary with respect to both the inner surface of the neck portion 18 and the fitment 22. This situation arises as a consequence of the relative angles of inclination to the central axis 14 of the inner surface 18 and the ramp surfaces 40 as well as a consequence of the relative coefficients of friction between the materials employed. These factors combine to enable the respective points of contact between each of the balls 38 and the inner surface 18 to resist slip whilst permitting slip between the balls and their respective ramp surfaces 40.

In another arrangement the angle of inclination of the ramp surfaces 40 and the relative coefficients of friction between the ramp surfaces 40 and the balls 38 may be such as to permit the balls 38 to roll along their respective ramp surfaces 40 toward the outwardly directed shoulder 42 as the body portion 28 is pulled from the neck portion 12. At the same time, however, the relative angle of inclination of the inner surface 18 and the relative coefficients of friction between the inner surface 18 and the balls 38 may be such that this same rolling movement causes the balls 38 to bite progressively harder and harder into the neck portion 18.

In either event, movement of the balls 38 in the direction of the withdrawal of the body portion 28 is prevented. This is also the case even if the bottle 10 should be inverted by virtue of the engagement of the balls with the spring 48 which serves to maintain the balls in engagement with both the ramp surfaces 40 and the inner surface of the neck portion 18.

Because of the non-movement of the balls 38 with respect to the bottle 10 and the progressively narrower distance between the ramp surfaces 40 and the inner surface 18 of the neck portion 12, the outwardly directed force exerted by the balls on the neck portion 12 increases dramatically as the device 26 is attempted to be withdrawn from the bottle 10 and as the point of contact between the balls and their respective ramp surfaces moves towards the shoulder 42. Long before the device 26 can be removed from the bottle 10 this force becomes sufficiently large to shatter the glass of the neck portion 12, thereby rendering the bottle useless to the counterfeiter and providing the ultimate tamper-evident signal to innocent third parties.

Figure 3:
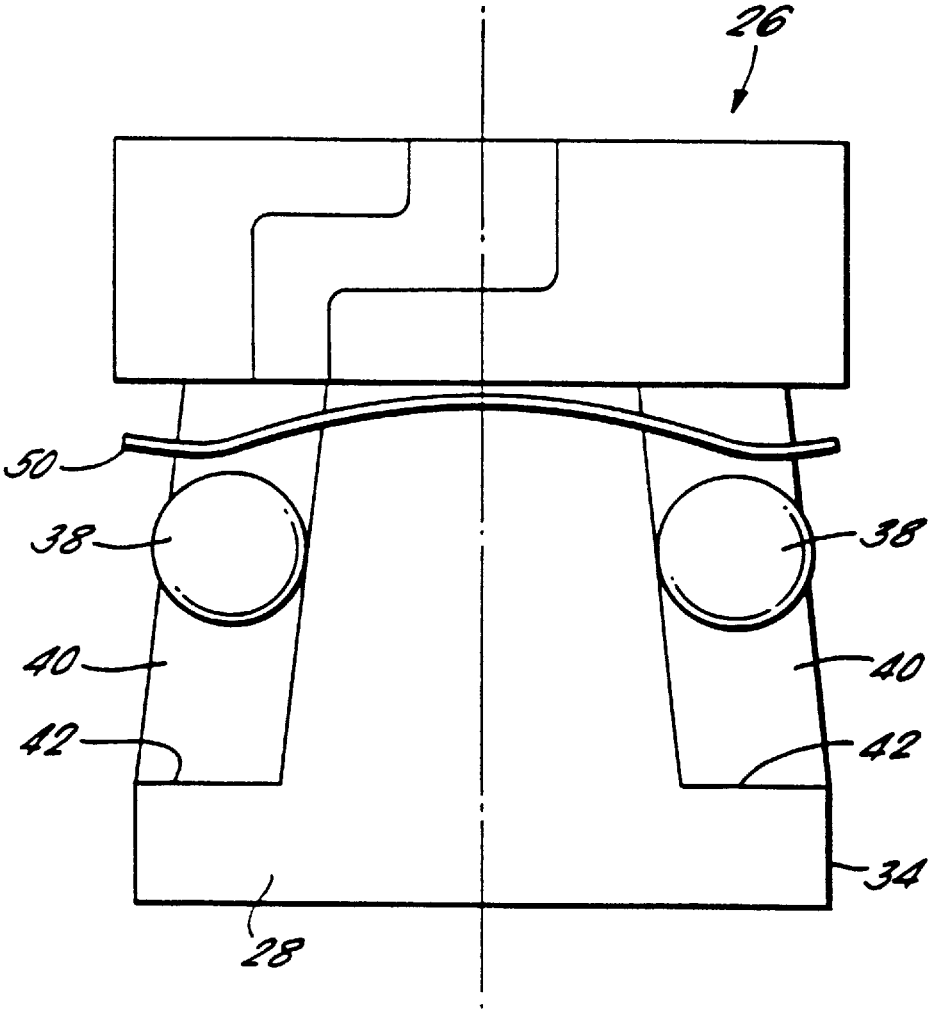
FIG. 3 is a lateral side view of a fitment removal prevention device in accordance with a second embodiment of the present invention.

It will be apparent to those skilled in the art that whilst the balls 38 have been illustrated as being biased towards the fitment 22 by means of a spring 38, this need not necessarily be the case. For example, in the embodiment shown in FIG. 3 the balls 38 are biased towards the fitment 22 by means of a circlip 50.

Figure 4:
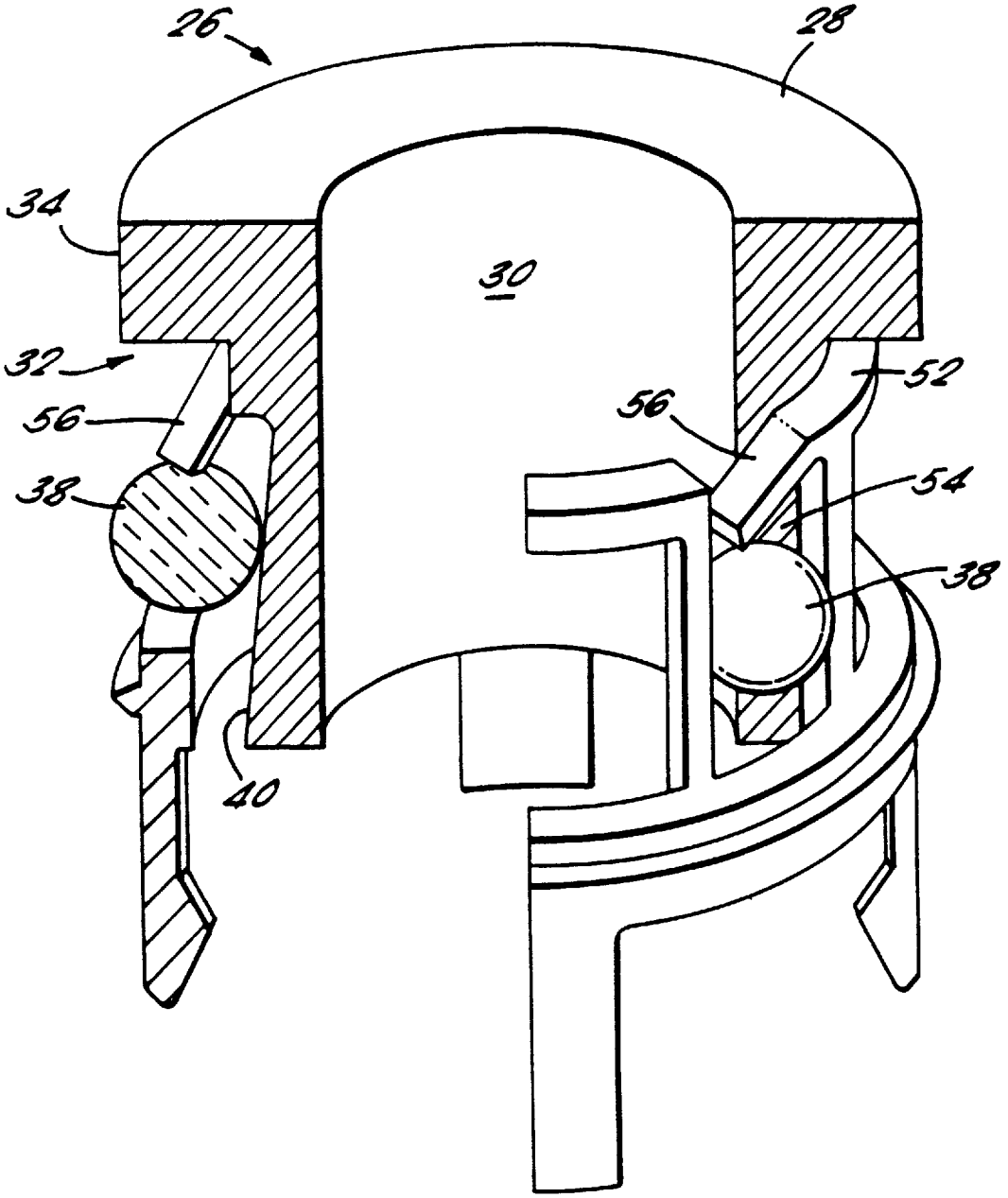
FIG. 4 is a perspective view of a fitment removal prevention device in accordance with a third embodiment of the present invention, with parts of the device broken away for the sake of clarity.

In another embodiment, shown in FIG. 4, the balls 38 are held in position with respect to the body portion 28 by means of a cage 52. As can be seen, the cage 52, which is substantially cylindrical in shape, includes respective circumferential openings 54 for the receipt of the balls 38, each of which openings is spaced by 120 degrees. However, in addition to simply retaining the balls 38 with respect to the body portion 28, that part of the cage 52 defining each of the openings 54 is also provided with a respective downwardly-directed resilient member 56 for engagement with the balls such that, in use, the balls are biased towards the fitment 22.

Figure 5:
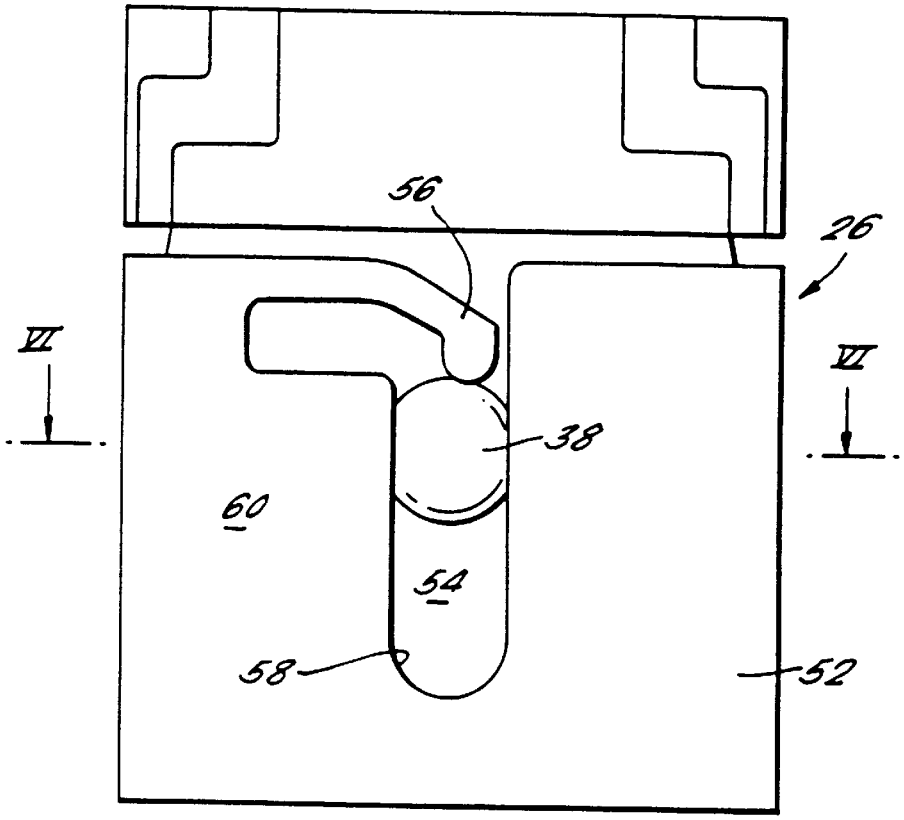
FIG. 5 is a lateral side view of a fitment removal prevention device in accordance with a fourth embodiment of the present invention.
Figure 6:
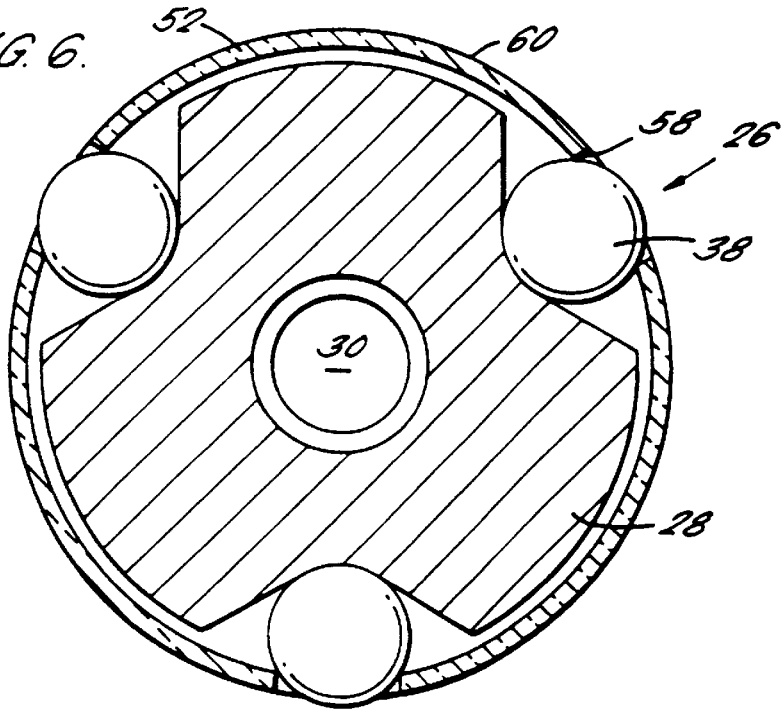
FIG. 6 is a cross-sectional view of the device of FIG. 5 taken along lines VI—VI.

A further example is shown in FIG. 5 in which the circumferential openings 54 are defined by respective cut-away portions 58 within an outer cylindrical surface 60 of the cage 52.

As shown in FIGS. 4 and 5, the resilient member 56 may be formed integrally with both the cage 52 and the body portion 28 and in so doing provides a removal prevention device 26 that is particularly easy to insert within the neck portion 12 of a bottle 10.

Likewise, it will also be apparent that the removal prevention device 26 may be formed integrally with the fitment 22, thereby further facilitating the encapsulating of the bottle and its contents.

Figure 7:
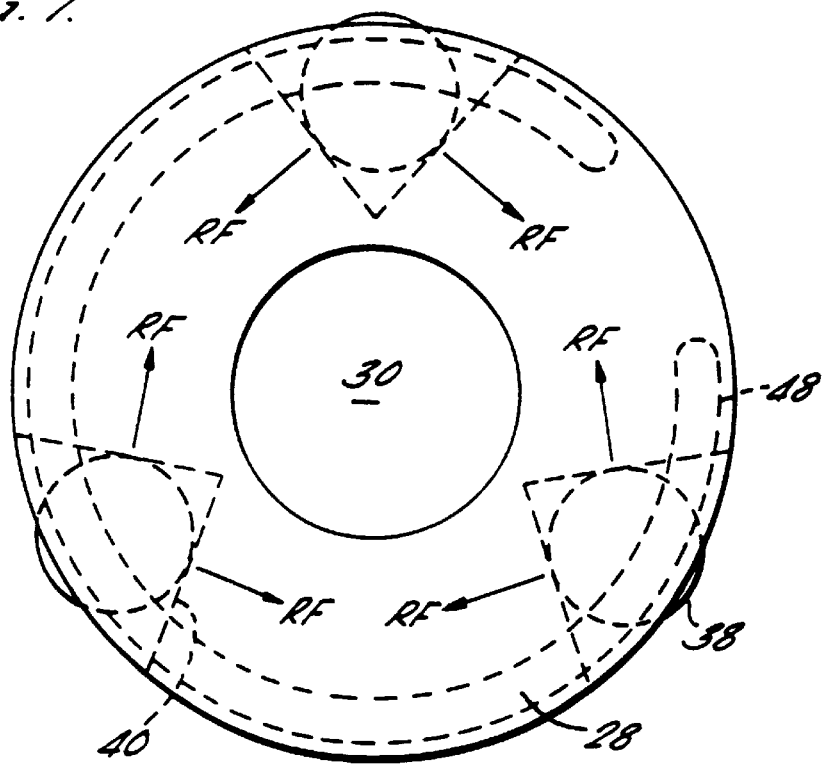
FIG. 7 is a cross-sectional view of a fitment removal prevention device in accordance with a fifth embodiment of the present invention.

Whilst the ramp surfaces 40 have been described as being arcuate in a cross-section taken perpendicular to the central axis 14, it will be apparent that this also need not necessarily be the case. Indeed, in cross-section these ramp surfaces 40 may be triangular, square or any other convenient shape. One advantage, of providing the body portion 28 with ramp surfaces 40 that are substantially triangular in cross-section is that such a surface provides two points of contact for each of the balls 38 as shown in FIG. 7. Because none of the lines that may be drawn between the centres of the balls 38 and their various points of contact with the body portion 28 intersect the central axis 14, the reaction forces RF that, in use, are exerted on the body portion by the balls immediately prior to the shattering of the neck portion 12 may be absorbed other than through the centre of the body portion. As a result the central through bore 30 may be of increased diameter without compromising the rigidity of the body portion 28. This in turn leads to an improvement in the ability of the device 26 to dispense the contents of the bottle, since by having a through bore 30 of increased diameter it is easier for both air to enter the bottle and the bottle contents to be poured out.

Figure 8:
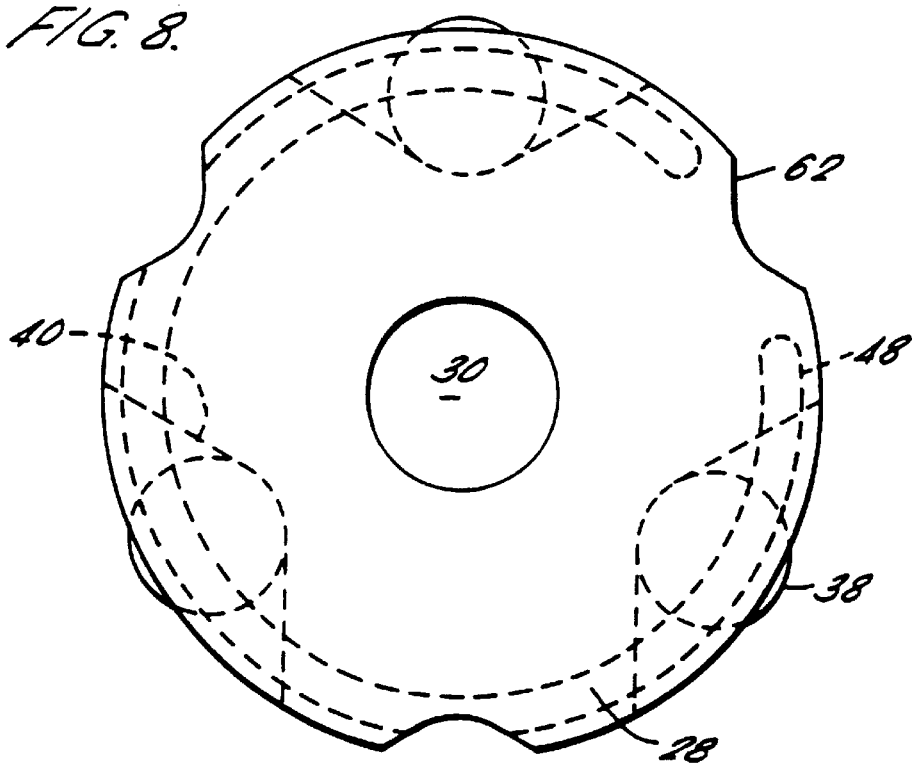
FIG. 8 is a cross-sectional view of a fitment removal prevention device in accordance with a sixth embodiment of the present invention.

In an alternative embodiment shown in FIG. 8 in which the ramp surfaces 40 are again of arcuate cross-section, the body portion 28 is additionally provided with a number of circumferentially spaced cut-away portions 62 at locations intermediate the cut-away regions 32. In this embodiment even though the diameter of the central through bore 30 is limited by the fact that the reaction forces are to be absorbed through the centre and by the need not to compromise the rigidity of the body portion 28, an improvement is obtained in the dispensing of the contents of the bottle since air is free to enter the bottle 10 through the cut-away portions 62, leaving the through bore 30 for the pouring of the contents.

Again, whilst the ramp surfaces 40 have been illustrated as being rectilinear in a plane that contains the central axis 14, it will be apparent that this again need not necessarily be the case. Indeed, in a cross-section that includes the central axis 14, the ramp surfaces 40 may be flared outwardly towards the fitment 22 so that as the point of contact between the balls 38 and their respective ramp surfaces moves towards the shoulder 42, the distance between the ramp surfaces and the inner surface of the neck portion 18 decreases at a more rapid rate. In this way the outwardly directed force exerted by the balls 38 on the neck portion 12 will be increased for a given displacement of the device 26 with respect to the bottle 10.

In an alternative embodiment, the ramp surfaces 40, instead of being disposed in a plane that contains the central axis 14, may extend helically of the body portion 28. In this way the neck portion 12 may still be shattered even if an attempt is made to unscrew the device 26 from the bottle 10.

Figure 9:
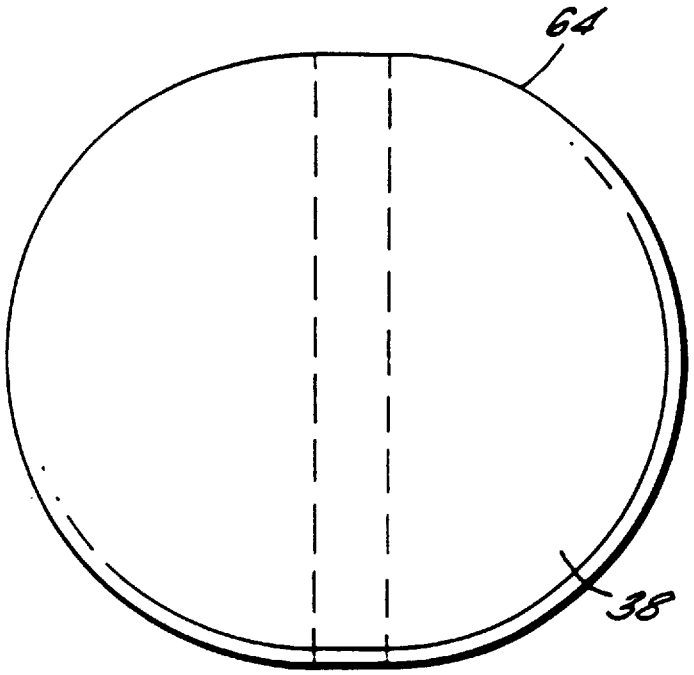
FIG. 9 is a lateral side view of a "ball" for use in connection with a filament removal prevention device in accordance with any of the foregoing embodiments.

In a preferred embodiment the balls 38 comprises ceramic spheres of approximately 3 mm in diameter. It will be apparent, however, that this need not necessarily be the case. In alternative embodiments which are not specifically illustrated the "balls" may be provided with any convenient rolling surface and as such may be cylindrical or even barrel-shaped. This flexibility in the design of the "balls" enables the use of simplified manufacturing techniques which, whilst not producing a perfect sphere, results in a "ball" such as that shown in FIG. 9 which has a more than adequate rolling surface 64.

Likewise, it will be apparent that the balls 38 do not necessarily have to be formed of a ceramic material. However, it has been found that such a material, along with stainless steel, has the necessary crush-resistant properties to withstand the reaction forces exerted on the balls by the bottle 10 immediately prior to the shattering of the neck portion 12.

Figure 10:
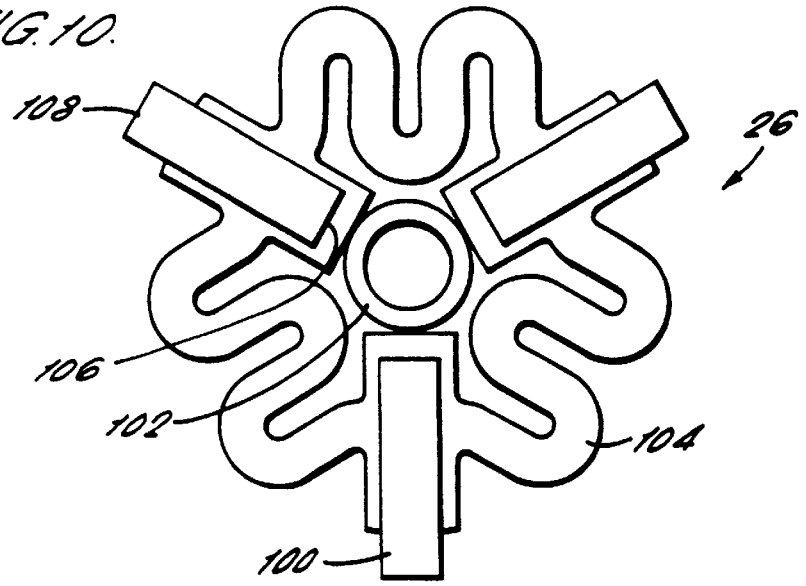
FIG. 10 is a plan view of a fitment removal prevention device in accordance with a seventh embodiment of the present invention.

In another embodiment shown in FIG. 10, the removal prevention device 26 comprises three radially disposed sprag elements 100 which are spaced 120 degrees apart around a central conduit 102 and are interconnected by means of a serpentine spring member 104. As can be seen more clearly in FIG. 11, each sprag element 100 is substantially planar in nature and comprises opposed radially inwardly and outwardly directed arcuate end surfaces 106 and 108 as well as outwardly tapering upper and lower surfaces 110 and 112. Of the two opposed radially directed surfaces, the outer surface 108 engages the inner surface of the neck portion 18, while a heel portion 114 of the inner surface 106 engages the outer surface 116 of the central conduit 102. The conduit 102, which communicates with the passage 24 provided in the fitment 22, is flared outwardly toward the mouth 20 of the bottle 10 and so defines an outwardly directed shoulder 118 at the intersection of the flared portion 120 with the remainder of the conduit. It is with this shoulder 118 that the heel portion 114 of each of the sprag elements 100 engages.

Although both the end surfaces 104 and 106 are accurate in a plane that contains the central axis 14, the two surfaces have different centres of curvature 122 and 124 that are displaced with respect to each other. As a result each sprag element 100 may act as an over-centre locking member.

In use, the fitment 22 may be inserted within the neck portion 12 in any convenient manner. The removal prevention device 26 is then presented to the mouth of the bottle 10 and pushed home. By applying a central force to the device 26 in the direction of insertion in such a way that the conduit 102 engages the fitment 22, each of the sprag elements 100 is caused to frictionally engage both the inner surface of the neck portion 18 and the outer surface 116 of the conduit 102. As a result the overall width of the device 26 in a plane perpendicular to the central axis 14 is reduced, thereby enabling the sprag elements 100 to adopt the position shown in FIG. 11 in which their respective upper and lower surfaces 110 and 112 are both inclined downwardly toward the central axis 14 and in which their respective points of contact with the conduit 102 are disposed closer to the fitment 22 than are their respective points of contact with the inner surface of the neck portion 18.

Figure 11:
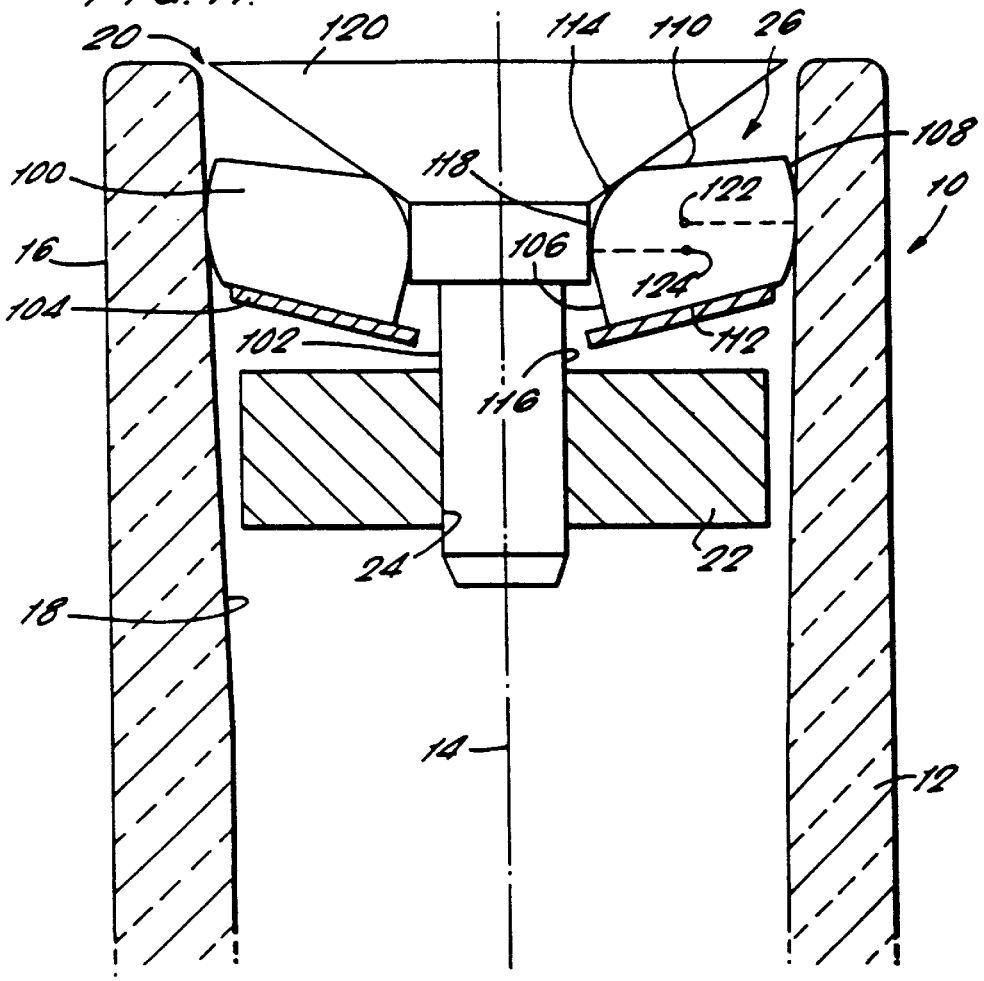
FIG. 11 is a cross-sectional view of a neck portion of a container in which the device of FIG. 10 has been inserted.

With the fitment and the device in the position shown in FIG. 11 the contents of the bottle 10 may be dispensed in the usual way. Thus, if the bottle were to be inverted the contents would flow through the passage 24 in the fitment 22, through the communicating conduit 102 and out of the mouth of the bottle by way of the flared portion 120.

At the same time however, the device 26 serves to prevent the removal of the fitment 22 from the bottle 10 since to do so the potential counterfeiter must again first remove the device itself. If he should attempt to do this by simply pulling the conduit 102 out of the bottle 10, each of the sprag elements 100 would have to pivot about their respective points of contact with both the inner surface of the neck portion 18 and with the outer surface of the conduit 116. This time however, instead of tending to decrease the overall width of the device 26 in a plane perpendicular to the central axis 14, this movement would tend to increase the overall width, as the upper and lower surfaces 110 and 112 are pivoted through the horizontal and to a position in which the points of contact between the respective sprag elements and the conduit 102 are disposed further from the fitment 22 than are the points of contact between the sprag elements and the inner surface of the neck portion 18. During this movement the forces exerted on the neck portion 12 by each of the sprag elements 100 increase until they reach a value at which the glass of the neck portion shatters, thereby again rendering the bottle 10 useless to the counterfeiter.

It will be apparent to those skilled in the art that the sprag elements 100 may be formed of any convenient rigid material such as a metal. Having said that however, it has been found that the coefficient of fiction between some metal sprag elements 100 and the inner surface of the neck portion 18 is not sufficiently high to prevent the device 26 from slipping with respect to the bottle, should the device be attempted to be withdrawn. Accordingly, the sprag elements 100, if formed of metal, are preferably also coated on their respective radially outwardly directed end surfaces 106 with a suitable material such as ceramic which has an increased coefficient of friction.

Figure 12:
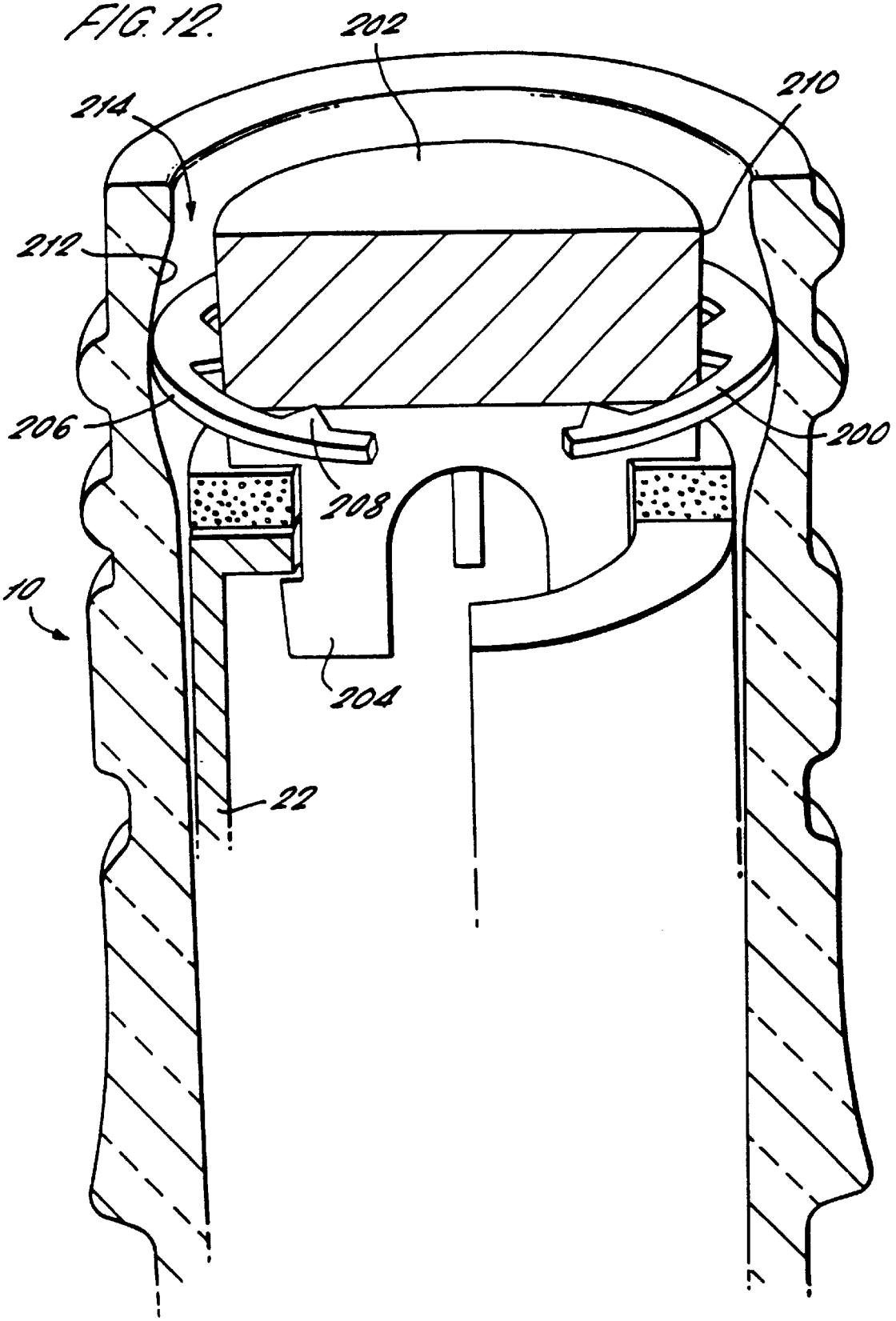
FIG. 12 is a perspective view of a neck portion of a container in which there is disposed a fitment removal prevention device in accordance with an eighth embodiment of the present invention, with parts of the container neck portion and of the device broken away for the sake of clarity.

In another embodiment shown in FIG. 12, the removal prevention device 26 comprises an open star washer 200 adapted for engagement with a plug 202 that serves to shield the fitment 22. To this end the plug 202 may be isolated from the fitment 22, or alternatively, as shown, may be provided with one or more formations 204 with which the fitment may engage.

As can be seen, the open star washer 200 is part annular in shape and comprises a rim portion 206 from which there project a number of radially inwardly directed pointed teeth 208. The teeth 208 engage an outer surface 210 of the plug 202 which is disposed centrally of the star washer 200 and which is of substantially frustoconical shape.

In contrast to the previously described embodiments, the inner surface of the neck portion 18 is provided adjacent the mouth portion 20 with an undercut region 212.

In use, once the fitment 22 has been inserted within the neck portion of the bottle 18, the removal prevention device 26 may be presented to the mouth of the bottle 10 and pushed home. In so doing, a central force is applied to the plug 202 in the direction of insertion, thereby urging the teeth 208 downwardly with respect to the rim portion 206. As a result the overall width of the star washer 200 is reduced in a plane perpendicular to the central axis 14 and this allows the device 26 to be inserted into the neck portion 12 with the rim portion 206 in engagement with the undercut region 212. Once the insertion force is removed, the star washer 200 springs outwardly for a more secure engagement with the inner surface of the neck portion 18. Nevertheless the points at which the various teeth 208 engage the outer surface of the plug 210 remain closer to the fitment 22 then do the points at which the rim portion 206 engages the under cut region 212. Thus again the star washer 200 acts as an over-centre locking member.

With the fitment and device in the position shown in FIG. 12 the contents of the bottle 10 may be dispensed in the usual way. To this end the plug 202 may be provided with a central through bore which communicates with the passage 24 provided in the fitment 22. Alternatively reliance may be placed on the annual spacing 214 between the plug and the neck portion 12.

At the same time however, the device 26 serves to prevent the removal of the fitment 22 from the bottle 10, since to do so the potential counterfeiter must again first remove the device itself. If he should attempt to do this by extracting the plug 202 from the bottle 10, the teeth 208 which engage the outer surface of the plug 210 would be urged upwardly with respect to the rim portion 206. Rather than decreasing the overall width of the star washer 200 in a plane perpendicular to the central axis 14, this movement tends to increase that width as the teeth 208 are attempted to be pivoted through the horizontal to a position in which they engage the outer surface of the plug 210 at a point further from the fitment 22 then that at which the rim portion 206 engages the undercut region 212. As a consequence the outwardly directed force exerted on the neck portion 12 by the star washer 200 is increased, causing the device 26 to jam in position and prevent the further withdrawal of the plug 202 from the bottle 10.

It will be apparent to those skilled in the art that the fitment removal prevention devices described above may also find use in connection with containers made of materials other than glass. All that is required is that the mouth portion of the container be of a rigid material. Although there are advantages in the mouth portion being formed of a frangible material, such as glass, since in this way the attempted withdrawal of the device may result in the destruction of the mouth portion, this need not necessarily be the case. If, for example, the mouth portion were formed of a rigid but non-frangible material, the attempted withdrawal of the device, whilst not resulting in the destruction of the mouth portion, would result in the jamming of the device within the container and so would still prevent the removal of the fitment.

We claim:

1. A fitment removal prevention device for insertion within a container, said device comprising a body portion; an incompressible member moveable with respect to said body portion between a first position, in which said device is insertable into a container having a mouth portion, and a second position, in which, when said device is inserted into the container, said incompressible member engages the container and exerts a force on the container mouth portion in a first direction having a component transverse to the direction of extraction of said device from the container; and resilient biasing means for biasing said incompressible member from the first position toward the second position, said incompressible member in the second position, with said device in the container, exerting an increased force on the container mouth portion in the first direction upon attempted extraction of said device from the container so as to retain said device in the container.

2. A device in accordance with claim 1, wherein said device has a dimension perpendicular to the direction of extraction of said device from the container when said incompressible member is in the second position which is greater than the corresponding dimension when said incompressible member is in the first position.

3. A device in accordance with claim 1, wherein said body portion includes a ramp surface inclined inwardly of the mouth portion in the direction of extraction of said device from the container, said incompressible member being in engagement with said ramp surface, and wherein said biasing means biases said incompressible member in a direction having a component opposed to the direction of extraction.

4. A device in accordance with claim 3, wherein in the first position, said incompressible member engages a first portion of said ramp surfaces, and in the second position said incompressible member engages a second portion of said ramp surface, the movement of said incompressible member between the first and second positions being in a direction having a component transverse to the direction of extraction of said device from the container.

5. A device in accordance with claim 3, wherein said ramp surface and said incompressible member are shaped such that a reaction force exerted by the mouth portion on said incompressible member may be absorbed other than through the center of said body portion.

6. A device in accordance with claim 3, wherein said ramp surface has a shape in a cross-section taken perpendicular to the direction of extraction of said device from the container selected from the group consisting of arcuate, triangular and square.

7. A device in accordance with claim 3, wherein said ramp surface is flared outwardly in a direction opposed to said direction of extraction of the device from the container.

8. A device in accordance with claim 3, wherein said ramp surface is disposed helically of said body portion.

9. A device in accordance with claim 3, wherein said device includes a plurality of said incompressible members, and said body portion includes a plurality of the ramp surfaces around the periphery thereof, each ramp surface being angularly spaced from the adjacent ramp surfaces, and each ramp surface being in engagement with a respective one of said plurality of incompressible members.

10. A device in accordance with claim 3, wherein said incompressible member has a rolling surface for engagement with said ramp surface.

11. A device in accordance with claim 10, wherein said incompressible member has a shape selected from the group consisting of spherical, part-spherical, cylindrical and barrel-shaped.

12. A device in accordance with claim 1, further comprising means for retaining said incompressible member with respect to said body portion.

13. A device in accordance with claim 12, wherein said resilient biasing means are provided integrally of said retaining means.

14. A device in accordance with claim 1, wherein said incompressible member comprises an over-centre locking member for frictionally engaging the container when in the second position.

15. A device in accordance with claim 14, wherein incompressible member comprises a plurality of sprag elements angularly spaced about said periphery of the body portion.

16. A device in accordance with claim 14, wherein said incompressible member is disposed peripherally of said body portions, and wherein said biasing means causes said incompressible member to flex from the first position to the second position.

17. A device in accordance with claim 1, wherein said body portion is provided with a through bore for communicating with the interior of the container.

18. A device in accordance with claim 1, wherein said body portion has a plurality of cut-away portions around the periphery thereof, for cooperating with the container mouth portion to define a plurality of openings communicating with the interior of the container.

19. A device in accordance with claim 1, further comprising a one-way liquid dispensing valve or other fitment formed integrally with said device.

20. In combination, a fitment removal prevention device, and a container having a rigid mouth portion, said device comprising a body portion; an incompressible member moveable with respect to said body portion between a first position, in which said device is insertable into said container, and a second position, in which, with said device within said container mouth portion, said incompressible member engages said container and exerts a force on said container mouth portion in a first direction having a component transverse to the direction of extraction of said device from said container; and resilient means biasing said incompressible member from the first position toward the second position, said incompressible member in the second position exerting an increased force on said mouth portion in the first direction upon attempted extraction of said device from said container so as to retain said device in said container.

21. The combination of claim 20, wherein said container mouth portion is frangible and the increased force exerted by said incompressible member said mouth portion upon the attempted extraction of said device from said container is sufficient to break said mouth portion.

22. The combination of claim 20, wherein said container mouth portion includes one or more formations for engagement by said incompressible member when said incompressible member is in the second position.

23. The combination of claim 20, wherein:

said body portion includes a ramp surface inclined inwardly of said mouth portion in the direction of extraction of said device from said container, said incompressible member is in engagement with said ramp surface and biased in a direction having a component opposed to the direction of extraction, said mouth portion has an inner surface that tapers outwardly in the direction of extraction of said device from said container, and said ramp surface is inclined inwardly of said mouth portion in the direction of extraction at an angle which is greater than the angle at which said inner surface is tapered outwardly.

24. The combination of claim 20, wherein:

said body portion includes a ramp surface inclined inwardly of said container mouth portion in the direction of extraction of said device from said container, said incompressible member is in engagement with said ramp surface and biased in a direction having a component opposed to the direction of extraction, and the coefficient of friction between said incompressible member and said container mouth portion is such that substantially no slippage occurs between said incompressible member and said mouth portion upon attempted extraction of said device from said container.

25. The combination of claim 24, wherein the relative coefficients of friction between said incompressible member and said mouth portion and between said incompressible member and said ramp surface are such as to allow said incompressible member to roll with respect to said ramp surface as said device is attempted to be removed from said container.

* * * * *